United States Patent [19]

Monacelli

[11] Patent Number: 4,669,648

[45] Date of Patent: Jun. 2, 1987

[54] MAGAZINE FOR FASTENERS IN COILED FORM

[76] Inventor: Umberto Monacelli, Via Milazzo 1, 20 552 Monza, Italy

[21] Appl. No.: 671,375

[22] Filed: Nov. 14, 1984

[30] Foreign Application Priority Data

Nov. 14, 1983 [GB] United Kingdom ..... 8330324

[51] Int. Cl.[4] ..... B25C 1/00; B25C 1/04; B25C 7/00

[52] U.S. Cl. ..... 227/109; 227/120; 227/136

[58] Field of Search ..... 227/109, 120, 127, 128, 227/130, 136

[56] References Cited

U.S. PATENT DOCUMENTS

| | | | |
|---|---|---|---|
| 3,259,292 | 7/1966 | Maynard | 227/136 X |
| 3,330,462 | 7/1967 | Colechin et al. | 227/109 X |
| 3,450,255 | 6/1969 | Mosetich | 206/56 |
| 3,543,987 | 12/1970 | Obergfell | 227/136 |
| 3,558,031 | 1/1971 | Hillier | 227/136 X |
| 3,568,908 | 3/1971 | Bader | 227/136 X |
| 3,688,966 | 9/1972 | Perkins et al. | 227/127 |
| 3,945,551 | 3/1976 | Sato et al. | 227/136 |
| 4,319,705 | 3/1982 | Geist et al. | 227/136 X |
| 4,518,109 | 5/1985 | Shinoyamo | 227/109 |
| 4,585,154 | 4/1986 | Fealey et al. | 227/109 |

FOREIGN PATENT DOCUMENTS

| | | | |
|---|---|---|---|
| 57-51810 | 11/1982 | Japan | 227/109 |
| 953047 | 3/1964 | United Kingdom . | |
| 1188854 | 4/1970 | United Kingdom . | |
| 1239625 | 7/1971 | United Kingdom . | |
| 1567069 | 5/1980 | United Kingdom . | |

*Primary Examiner*—Paul A. Bell

*Attorney, Agent, or Firm*—Sughrue, Mion, Zinn, Macpeak, and Seas

[57] ABSTRACT

A magazine has a housing enclosing a cavity for a coil of fasteners. One member of the housing is movable, e.g. pivotable, to open the housing for reloading. A fastener support member extends across the cavity and is supported by support means on an internal wall of the housing.

12 Claims, 12 Drawing Figures

MAGAZINE FOR FASTENERS IN COILED FORM

The present invention relates to a magazine for fastener driving apparatus and for containing fasteners interconnected in series e.g. by parallel flexible and breakable materials bonded to the shank portion of each fastener. The fasteners are coiled in a magazine, carried by the body portion of the apparatus, and are delivered in use of the apparatus into feeding and driving sections to be driven therefrom.

It is most desirable to have the striker end of the fastener delivered to the feeding section at a predetermined height. The workpiece entering end therefore will vary in location as the fasteners vary in length. Thus the position of the workpiece entering ends will be variable in an axial direction within the magazine.

Many uses for this type of fastener driving apparatus require portable handling of the apparatus. Therefore lightness is a desirable feature, yet the magazine must be sturdy enough to withstand rugged handling. The magazine must also be easily and rapidly reloadable.

An object of this invention is to provide a magazine for fasteners in coil form to be used in conjunction with a fastener driving apparatus. Another object is to provide a fastener supporting plate with adjustability for fasteners of different lengths.

Yet another object is to provide a fastener magazine which is readily reloadable and sturdily constructed.

According to one aspect of the invention, there is provided a magazine for fastener driving apparatus and comprising a housing enclosing a cavity for containing a coiled fastener package, a member of said housing being movable for acess to said cavity to allow insertion of the coiled fastener package, characterised by a fastener support member extending across said cavity to support said package at a predetermined height and by support means on an internal wall of said housing to support said member in at least one position.

According to another aspect of the invention, there is provided fastener driving apparatus having the magazine of said one aspect.

For a better understanding of the invention, and to show how the same may be carried into effect, reference will now be made, by way of example, to the accompanying drawings, in which.

Figure 1:
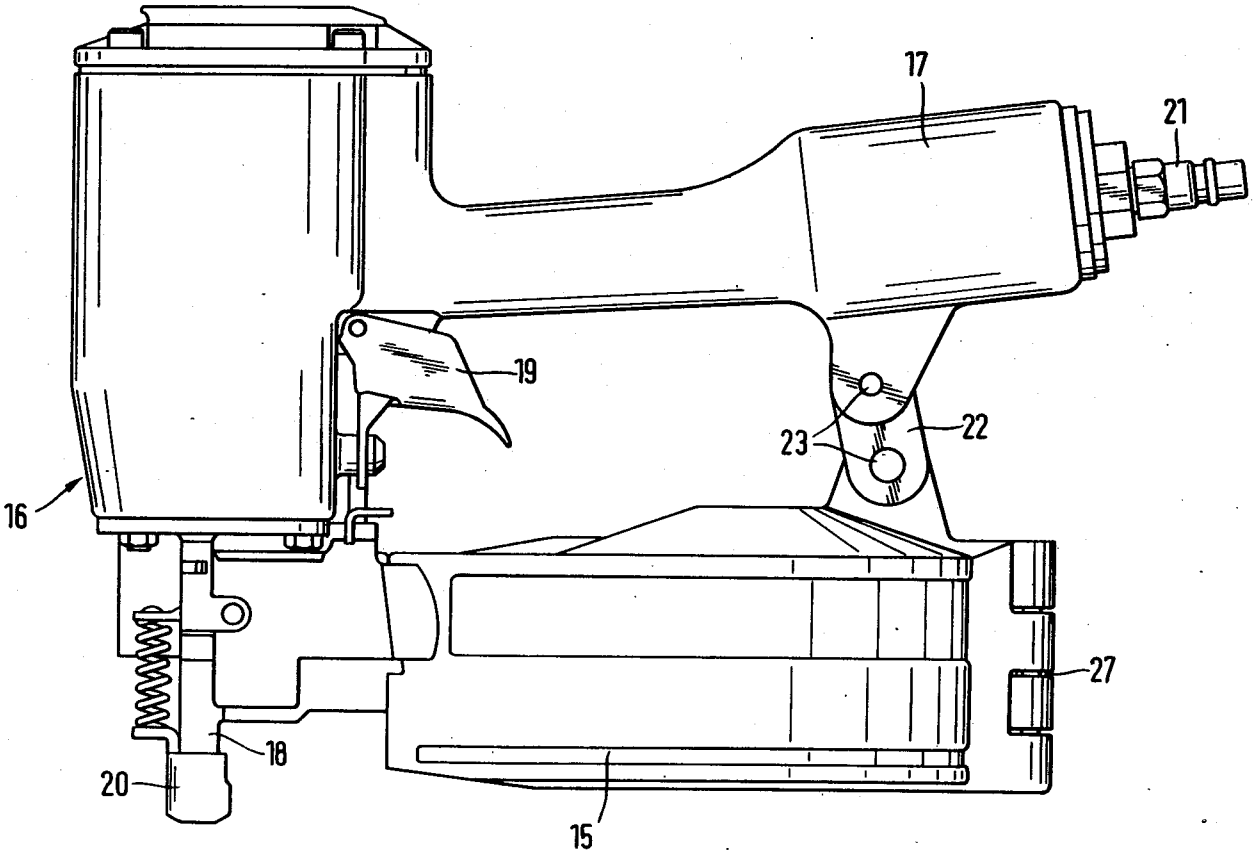
FIG. 1 is a side view of pneumatically operated fastener apparatus equipped with a magazine according to the invention.

Referring to FIG. 1 of the drawings, a magazine 15 is shown installed on a pneumatic fastener driving apparatus 16. The apparatus 16 has a body 17 within which air chambers, valves, pistons, drivers, fastener feeding device, etc., are installed to drive a succession of fasteners, such as nails, one at a time through the driving throat 18 into a workpiece. The valves, piston, driver, etc., within the body 17 are actuated by a manually operated trigger 19 in conjunction with a workpiece contact element 20 when the tool is connected to a compressed air supply at a connector 21. In cases where the apparatus is part of a stationary piece of equipment, the trigger 19 and contact element 20 may be replaced by automatic or semi-automatic actuating devices.

The magazine 15 is attached to the body 17 by a link 22 secured by fasteners 23 on this particular apparatus. The type of tool upon which the magazine is mounted forms no part of the present invention, thus the tool shown in FIG. 1 is for reference only and the attachment will vary depending on each tool configuration.

Figure 2:
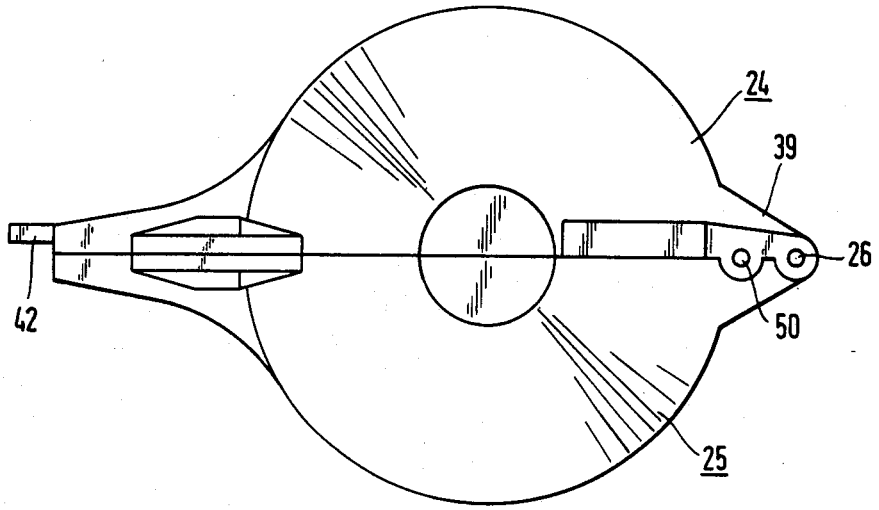
FIG. 2 is a plan view of the magazine in operative position.
Figure 3:
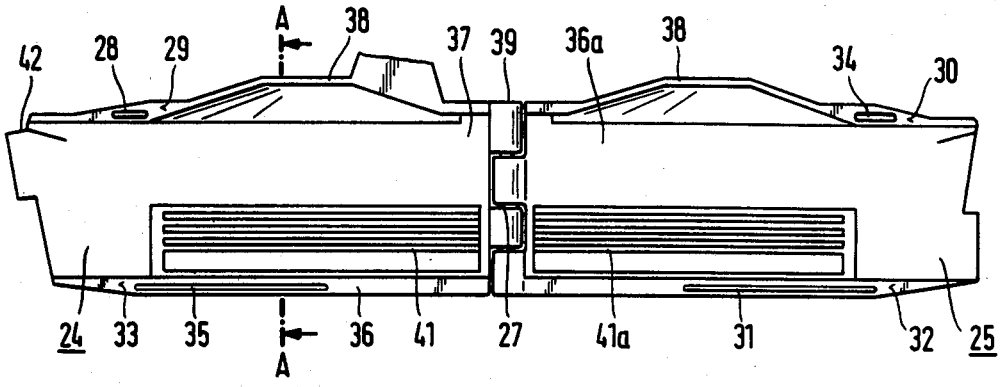
FIG. 3 is a side view of the magazine with a movable portion in open position.
Figure 4:
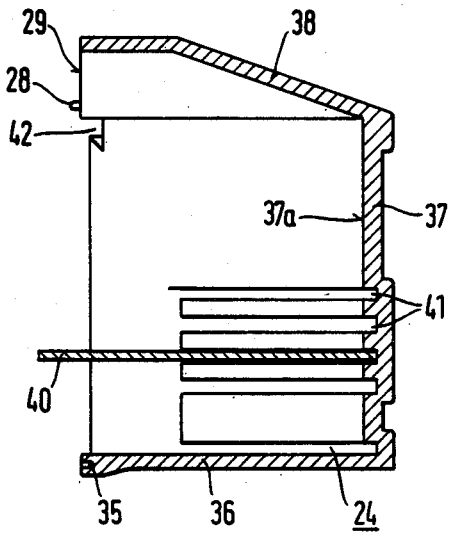
FIG. 4 is a cross-section taken along line A—A of FIG. 3.

Referring now to FIGS. 2, 3 and 4, the magazine includes a housing attachable to v arious style fastener driving devices. The housing has a generally circular base 36. Extending upwardly is a peripheral wall 37 with a funnel-shaped portion tapering towards a fastener exit. Attached to walls 37, as a continuation thereof, is a top portion 38 extending over the base 36. The housing is divided into two mutually pivotable sections formed by members 24 and 25 which meet, in their closed position, on a division plane passing vertically through the pivot axis and through the fastner exit parallel to the fastener delivery direction. The first housing member 24 has extensions 39 opposite the fastener exit end and transverse to base 36 for mounting a pivot means to allow the housing section to be openable. The second housing member 25 is, in this illustration, pivotal about a shaft 26. It could also of course be intelatched with member 24 by other different attachment methods. The pivoting movement allows access to the interior of the magazine for loading fasteners and clearing any jams should they occur. The pivot shaft 26 is secured within the housing members by press fit in the first member 24 and a clearance hole in the second member 25, or is contained within both by a retaining clip 27. A tap 28 extends transversely from a face 29 of housing member 24 to engage within a corresponding recess 34 in a face 30 of housing member 25. A second tab 31 extends transversely from a face 32 of housing member 25 to engage within a recess 35 in a face 33 of housing member 24. These are used for alignment and vertical support between members 24 and 25 when the members are closed in an operable position. The tabs and recesses could of course be of different configuration and location than that which is shown depending on the actual construction of the movable housing member 25.

Referring particularly to FIG. 4, a fastener supporting plate 40 which is substantially flat and generally circular in shape is disposed within the housing members 24 and 25, when the members are closed in an operable position, for support of the fasteners at their workpieceentering ends. The interior surface 37*a* of the peripheral wall 37, being generally circular in shape, has circumferential recesses 41, the number of which and spacing of which from the base 36 will depend on the length of fasteners to be driven in each particular apparatus 16. The striker ends of the fasteners will be positioned at a height such as to allow movement through the fastener delivery guide 42 when the plate 40 is located in the appropriate one of the recesses 41.

The loading operation is simple and imvolves unlatching means securing the movable member 25 closed, opening the member 25, placing the plate 40 in the correct recess 41 in member 24, placing a package of fasteners on the plate with striker ends aligned with delivery guide 42, closing member 25 making sure plate 40 fits into the corresponding recess 41*a* within member 25, and latching the securing means to hold members 24 and 25 in an operative closed position.

Figure 5:
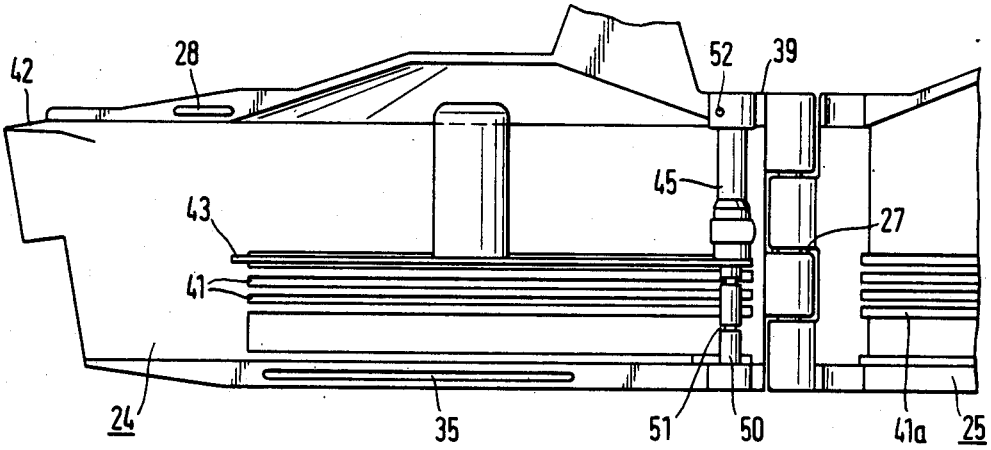
FIG. 5 is a side view of the magazine with the movable portion in open position and a fastener support plate positioned for minimum length fasteners.
Figure 7:
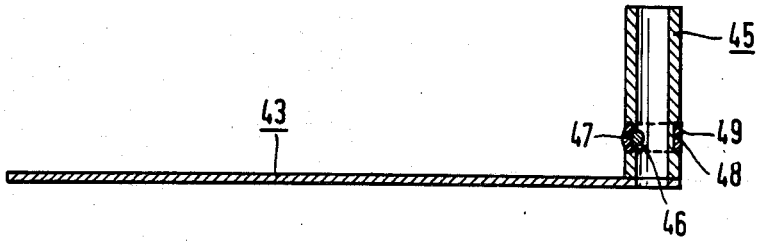
FIG. 7 is a cross-section taken along line B—B of FIG. 6.
Figure 6:
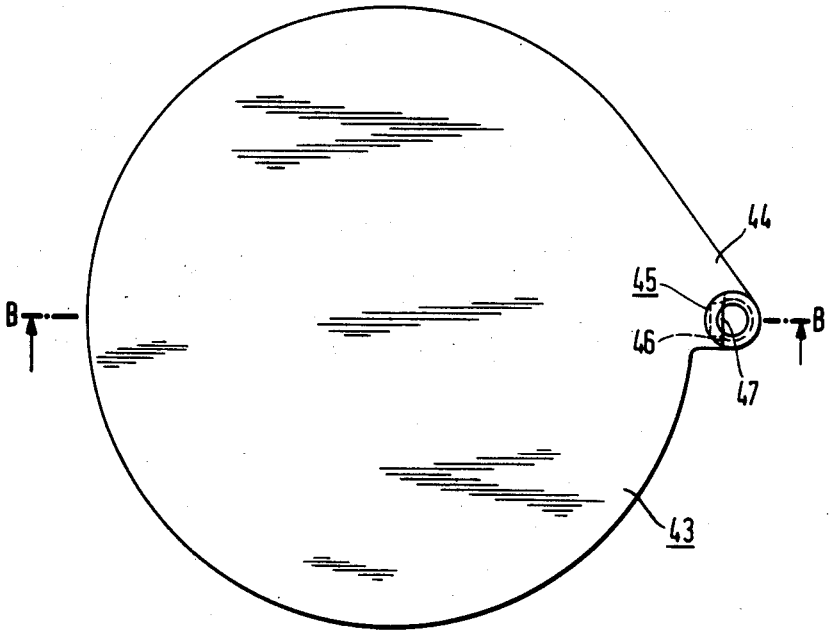
FIG. 6 is a plan view of the fastener support plate with a pivotal member.

For applications in which the same length fastener is used for long periods of time, it is convenient to have the fastener supporting plate 40 pre-aligned with the correct recess 41 for rapid reloading of fastener packages. Referring to FIGS. 5, 6 and 7, a fastener support plate 43, being generally circular in shape, has an extension 44 upon which transversely mounted is a tubular member 45. A slot 46 is cut transversely to the axis of tubular member 45 intersecting the interior wall thereof. A cylindrical member 47, such as a dowel pin or the like, is contained within slot 46 by a resilient element 48 such as neoprene band or the like. An undercut 49 in the tubular member 45 is used to maintain the resilient element 48 in proper location. A shaft 50 disposed transversely of base 36 is secured in a portion of extension 39. The shaft 50 has transverse grooves 51 spaced by the same vertical increments as recesses 41 in housing member 24. The shaft 50 is located vertically within housing member 24 such that the outer edge of support plate 43 aligns with the appropriate recess 41 when the cylindrical member 47 disposed within tubular member 45 is seated in the corresponding groove 51. The shaft 50 is fixed to housing member 24 with a pin 52 or the like. The fastener support plate 43 can thus be pivoted outwardly from housing member 24 for convenient loading of the fastener package and yet maintain the proper location when pivoted back within member 24.

When plate 43 is pivoted so as not to be confined within the recesses 41, it can be moved vertically to another location by exerting a force great enough to expand the resilient element 48 as the cylindrical member 47 moves out of the grooves 51 and over shaft 50. As the cylindrical member 47 aligns with another groove 51, the resilient element 48 forces the member 47 into the groove 51 thereby accurately locating the plate 43 with the proper recess 41.

Figure 9:
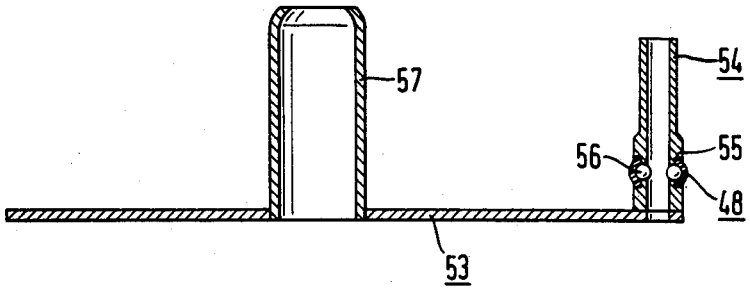
FIG. 9 is a cross-section taken along line C—C of FIG. 8.
Figure 8:
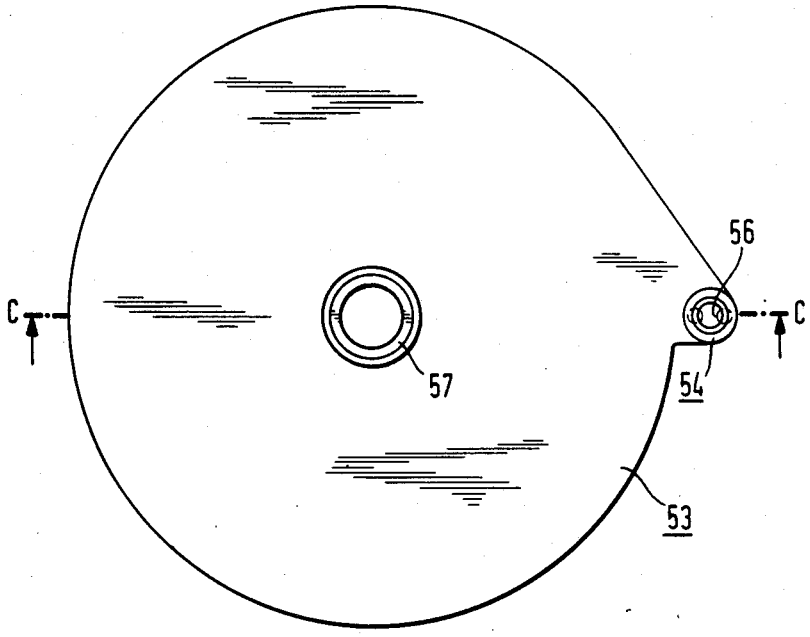
FIG. 8 is a plan view of a modified form of a fastener support plate.

Referring now to FIGS. 8 and 9, a modified pivotal fastener support plate 53 is shown. In this version, a tubular member 54 has a through-hole 5 transverse of the axis of the tubular member 43. Two spherical members 56 are disposed within tubular member 54 to perform the same function as cylindrical member 47 shown in FIG. 7. In addition, a transverse member 57 is attached to plate 53 for ease of alignment of a fastener package on plate 53.

Figure 11:
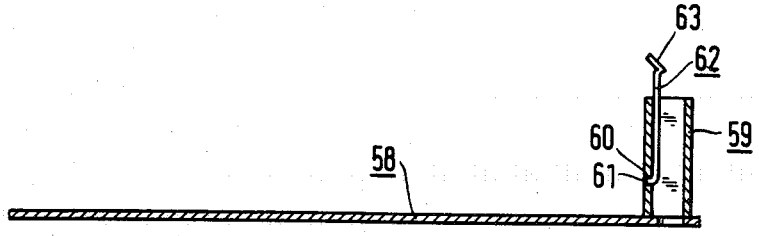
FIG. 11 is a cross-section taken along line D—D of FIG. 11.
Figure 10:
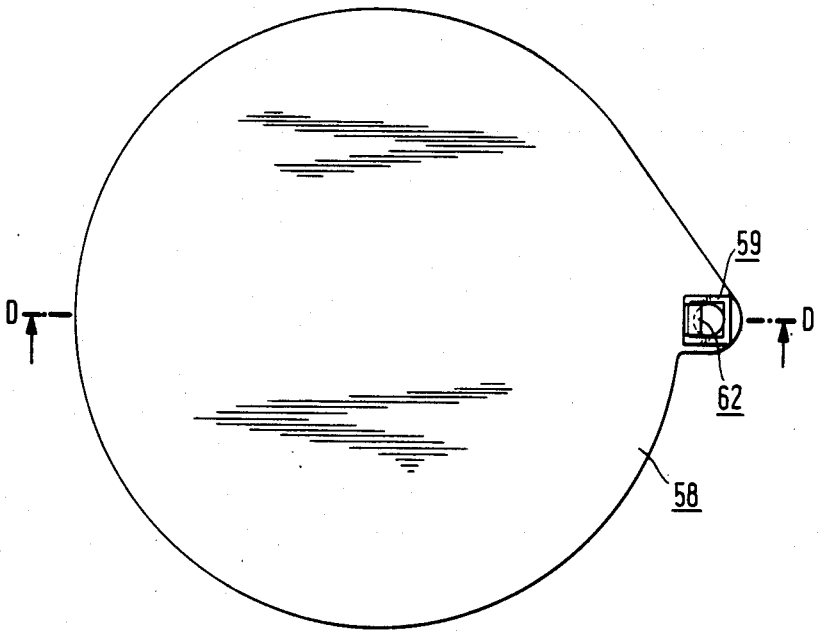
FIG. 10 is a plan view of a modified form of a fastener support plate.

FIGS. 10 and 11 show another modified version of a pivotal fastener support plate 58. In this case, a tubular member 59 has a slot 60 within which a retaining tab 61 is disposed as part of a resilient element 62. The element 62 is located generally along the axis of the tubular member 59 with the end 63, extending vertically above the tubular member 59, shaped such as to seat within a groove 51 of shaft 50. In all the embodiments of FIGS. 5 to 11 the fastener support plate is held in the predetermined vertical location when pivoted outward from recesses 41 and thus provides for rapid relocation if so desired.

Figure 12:
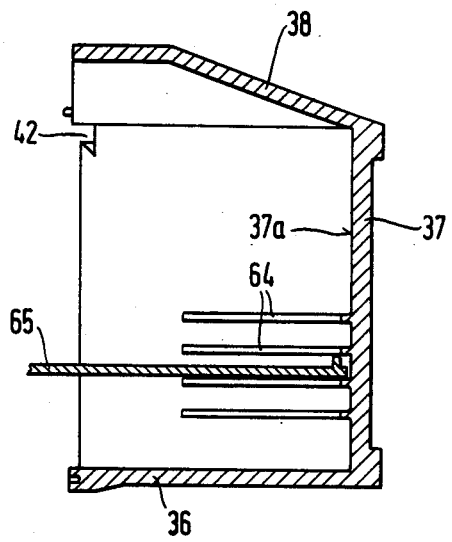
FIG. 12 is a cross-section wtih protrusion support in place of internal recesses.

Referring to FIG. 12, the interior surface 37*a* of the peripheral wall 37, being generally cylindrical in shape, has longitudinal protrusions 64 on a part thereof. The number of protrusions 64 and spacing from the base 36 will depend on the length of fasteners capable of being driven in each particular apparatus 16. A fastener support plate 65 rests on the top surface of the protrusions 64 and in turn locates the striker ends of the fasteners for longitudinal movement through the fastener delivery guide 42 when the plate 65 is located on the corresponding protrusions 64 related to the fastener length.

The loading and vertical adjustment of the plate 65 is the same as previously described for a housing containing internal recesses for positioning the fastener supporting plate.

The foregoing describes presently preferred embodiments of the invention, but it should be understood that the scope of the invention is determined by the appended claims.

I claim:

1. A magazine for a fastener driving apparatus comprising a housing having a central axis defining a cavity for receiving a coiled fastener package about said central axis, said housing being comprised of two members pivotally connected to each other for pivotal movement of one member relative to the other member about a pivot axis disposed parallel to said central axis, a fastener package support member, support means in said housing for supporting said member perpendicular to said central axis in at least one position along said central axis with said support member being moveable relative to said housing in a direction perpendicular to said central axis when said central housing members are pivoted about said pivot axis to an open condition.

2. A magazine according to claim 1 wherein said support means is arranged to support said member in at least two alternate positions.

3. A magazine according to claim 2 wherein said support means comprises at least one circumferentially extending groove.

4. A magazine according to claim 3 wherein two said grooves are provided at spaced positions corresponding to respective fastener lengths.

5. A magazine according to claim 1 wherein said support member is removable from said housing.

6. A magazine according to claim 1 wherein said support member is a plate.

7. A magazine according to claim 1 wherein said support member is pivotable on said housing to an exposed position substantially outside said cavity.

8. A magazine according to claim 7 wherein said housing has a shaft in a wall thereof and said support member has an extension engaging said shaft to form a connection pivotable about said shaft.

9. A magazine according to claim 8 wherein said tension comprises a tubular member.

10. A magazine according to claim 9 wherein said tubular member carries a retaining member at a position intermediate the ends thereof, said shaft has a recess positioned for engagement by said retaining member, and the retaining member is biassed into said recess by resilient means.

11. A magazine according to claim 10 wherein said retaining member is disposed in a cavity in a wall of said tubular member.

12. A fastener driving apparatus comprising an elongated handle having a head at one end thereof supporting a workpiece contact element and a magazine operatively connected to said handle and said head and disposed substantially parallel to said handle in close proximity thereto, said magazine comprising a housing having a central axis defining a cavity for receiving a coiled fastener package about said central axis, said housing being comprised of two members pivotally connected to each other for pivotal movement of one member relative to the other member about a pivot axis disposed parallel to said central axis, a fastener package support member, support means in said housing for supporting said member perpendicular to said central axis in at least one position along said central axis with said support member being moveable relative to said housing in a direction perpendicular to said central axis when said central housing members are pivoted about said pivot axis to an open condition.

* * * * *